US005094463A

United States Patent [19]

Dryden

[11] Patent Number: 5,094,463

[45] Date of Patent: Mar. 10, 1992

[54] DETACHABLE ARROW SHAFT INSERT

[76] Inventor: Michael S. Dryden, 212 Green St., Carpentersville, Ill. 60118

[21] Appl. No.: 617,214

[22] Filed: Nov. 23, 1990

Related U.S. Application Data

[63] Continuation-in-part of Ser. No. 422,060, Oct. 16, 1989, abandoned, which is a continuation-in-part of Ser. No. 169,780, Mar. 18, 1988, abandoned.

[51] Int. Cl.[5] ..... F42B 6/04

[52] U.S. Cl. ..... 273/416; 342/386

[58] Field of Search ..... 273/416, 418–422; 455/96, 98, 100, 66; 342/386; 43/6

[56] References Cited

U.S. PATENT DOCUMENTS

| | | | |
|---|---|---|---|
| 3,336,530 | 8/1967 | Sloan et al. | 455/95 |
| 3,790,948 | 2/1974 | Ratkovich | 455/98 |
| 4,340,930 | 7/1982 | Carissimi | 362/204 |
| 4,381,866 | 5/1983 | Simo | 273/422 |
| 4,405,133 | 9/1983 | Cartwright, Jr. | 273/419 |
| 4,421,319 | 12/1983 | Murphy | 273/416 |
| 4,544,163 | 10/1985 | Scanlon | 273/416 |
| 4,597,580 | 7/1986 | Gassie | 273/418 |
| 4,621,817 | 11/1986 | Musacchia | 273/421 |
| 4,651,999 | 3/1987 | Sturm | 273/416 |
| 4,675,683 | 6/1987 | Robinson et al. | 342/386 |
| 4,704,612 | 11/1987 | Boy et al. | 342/386 |
| 4,749,198 | 6/1988 | Brailean | 273/416 |
| 4,858,935 | 8/1989 | Capson | 273/416 |
| 4,885,800 | 12/1989 | Ragle | 273/416 X |
| 4,951,952 | 8/1990 | Saddler | 273/416 |
| 5,024,447 | 6/1991 | Jude | 273/416 |

FOREIGN PATENT DOCUMENTS 2052277 6/1980 United Kingdom ..... 273/423

OTHER PUBLICATIONS

Advertisement for "TAG-N-Trail": device appearing in Bowhunting Guide '87, Edition No. 215, 1987/88 Season.

Advertisement for "Bloodhound Tracking System" device appearing in article entitled Outlook '89 Limits On Equipment in unknown source.

Advertisement for "Aerotrak" device.

Advertisement for "Suretrak" device.

*Primary Examiner*—Paul E. Shapiro

*Attorney, Agent, or Firm*—Speckman & Pauley

[57] ABSTRACT

A detachable arrow shaft insert, battery housing and transmitter casing accommodating an arrowhead and allowing separation of the insert and thus transmitting means from the arrow shaft when the arrowhead is lodged in a target and an outward pulling force is applied to the arrow shaft. The arrow shaft insert has an insert body that fits within the arrow shaft. The insert body is secured with respect to the arrow shaft with O-rings, circumferential ribs, or longitudinal ribs. An electronic transmitter can be connected to one end of the insert body or battery housing such that the electronic transmitter is housed within the arrow shaft. A conventional arrowhead is attached to one end of the insert body. The arrowhead, insert body, battery housing and electronic transmitter, if used, will remain intact, lodged in an animal's body or target even if the arrow shaft is forcibly disengaged from the insert body.

12 Claims, 5 Drawing Sheets

DETACHABLE ARROW SHAFT INSERT

This application is a continuation-in-part patent application of my co-pending patent application having Ser. No. 07/422,060, filed Oct. 16, 1989, which is a continuation-in-part patent application of my abandoned patent application having Ser. No. 07/169,780, filed Mar. 18, 1988.

BACKGROUND OF THE INVENTION

1. Field of the Invention

This invention relates to a breakaway connection between a detachable arrow shaft insert and an arrow shaft whereby an arrowhead remains secured with respect to the arrow shaft during flight but the arrow shaft is separated from the arrowhead leaving the arrowhead lodged within a target.

2. Description of the Prior Art

Conventional recovery systems for arrows have transmitters which are either housed in the broadhead or arrowhead, or have components which are mounted external to the arrow shaft. Such systems drastically reduce the aerodynamic characteristics of the flight pattern of the arrow. Other conventional systems employ a transmitter housed within the arrow shaft. However, with the transmitter mounted within the arrow shaft, the transmitter is permanently secured within the arrow shaft. Conventional tracking systems do not compensate for removal of the transmitter in a situation where an animal, such as a deer, pulls the arrow shaft to dislodge the arrow from its body. When an animal removes the arrow from its body, which typically occurs when the animal is not immediately killed, the transmitter is removed from the animal and thus defeats the purpose of tracking the injured animal. Thus, it is one object of this invention to design a transmitter that can be housed within an arrow shaft in such a manner that when an animal exerts an outward pulling force on the arrow shaft, the arrow shaft separates from the arrow shaft insert leaving the arrowhead, arrow shaft insert and the transmitting means within the animal's body. With such a tracking system, it is apparent that even if the animal removes the arrow shaft or the arrow shaft catches a tree limb or the like and is removed from the animal's body, the transmitting means will remain lodged in the animal's body.

Conventional arrowheads have threaded shaft portions extending from the rearward end of the arrowhead. The external threads of such shafts engage with the internal threads of an arrow shaft insert or adapter sleeve permanently secured within the arrow shaft, for example with epoxy or another adhesive. Most arrow shaft inserts or adapter sleeves are permanently secured within the arrow shaft, since a primary concern of archers has been to remove the arrowhead when removing an arrow or arrow shaft from a target or animal. An amateur can easily remove a conventional or existing arrow shaft insert by heating the shaft, which melts the adhesive, and pulling the arrow shaft insert outward. In conventional arrowhead connections, the arrow shaft insert is also permanently attached to one end of an arrow shaft by having the arrow shaft and the insert an integral piece. Once the arrow shaft insert is permanently secured with respect to the arrow shaft, an arrowhead is threadedly engaged with the arrow shaft insert.

With respect to arrow tracking devices, one prior design, according to an advertisement in *Bowhunting guide* '87, Edition No. 215, 1987/88 Season, a "TAG-N-TRAIL" device marketed by flex-fletch products, for detecting the location of an animal, uses a string having one end attached to a harpoon. The harpoon attaches to a holding base mounted on the outer surface of an arrow shaft, near the arrowhead. Apparently, the line trailing from the harpoon has a free end. In such design, when an arrow discharges from the bow, the line end attached to the arrow shaft travels with the arrow and thus pulls the trailing line. The harpoon either lodges within or passes through the animal's body.

Further regarding arrow tracking devices, many problems arise with using a string attached to an arrow shaft for detecting the location of an animal. The length of string will reduce the distance the arrow can travel. Should the arrow hit an animal and cause the animal to run, the line may tangle in the brush and either sever the line or cause the arrow shaft to break. Long lengths of line left in the brush or at the hunting site create tripping hazards for both humans and animals. More importantly, the line attached to the harpoon which is mounted on the arrow shaft will create unnecessary drag forces that misguide the arrow and dramatically reduce the arrow aerodynamics. A harpoon and holding base mounted to the side of an arrow shaft also create an unbalanced arrow shaft which misguides the arrow during flight.

U.S. Pat. No. 4,704,612 discloses a method and apparatus for tracking and recovering a hunting arrow. A transmitter is mounted within an arrow shaft. The arrowhead is mounted in an insert which is fixedly and permanently secured within the arrow shaft. Once the arrow is shot, an inertia-activation switch momentarily closes, causing the transmitter to switch on and transmit a signal.

U.S. Pat. No. 4,544,163 teaches an arrow nock having a cylindrical body with a plug shaft with longitudinal grooves to accept adhesive to ensure that there is an adhesive bond between the interior of the arrow shaft and the nock plug.

U.S. Pat. No. 4,381,866 discloses an arrowhead assembly which includes a compressible, resilient O-ring which fits over the blade carrying body and is adjacent a rearward side of a nondeformable blade locking ring. The opposite side of the O-ring is adjacent the front and external face of an arrow shaft insert. The compressible O-ring is compressed when the arrowhead is assembled and thus uneven forces by the compressible ring are accommodated by canting of the nondeformable blade locking ring thereby providing solid engagement of the mating bevel and the chamfer while tightly holding the removable blades in position. It is noted that in an assembled position, the compressible O-ring is not housed within the cavity of the arrow shaft insert, but rather is external to the arrow shaft insert.

U.S. Pat. No. 4,749,198 discloses a trackable arrow which includes a transmitter mounted within the arrow shaft. The arrowhead is mounted within an insert which is permanently held in place by an interference fit with the inside walls of the arrow shaft. The '198 patent neither teaches nor suggests an intentionally detachable connection between the arrow shaft insert and the arrow shaft, which would enable an animal to remove an arrow shaft from an arrow which is lodged in its body while leaving the arrowhead and arrowhead insert within its body.

SUMMARY OF THE INVENTION

It is one object of this invention to provide a detachable arrow shaft insert, battery housing and transmitter casing for detachably connecting an arrowhead and attached transmitting means within an arrow shaft.

It is another object of this invention to provide a detachable arrow shaft insert, battery housing and transmitter casing which remains secured within an arrow shaft during handling and shooting of the arrow but separates from the arrow shaft when an animal exerts a pulling force to a rearward portion of the arrow shaft.

In one embodiment of this invention, the arrow shaft insert has a plurality of circumferential grooves, preferably two or three, located on the outside surface of the insert. The circumferential grooves accommodate O-rings. The O-rings provide a detachable compression fitting or press fit between the insert and the arrow shaft. The circumferential grooves are positioned and sufficiently spaced to provide stability between the insert and the arrow shaft. It is apparent that the insert can be constructed from plastic or another suitable rigid but resilient material which has external ribs, circumferential or longitudinal, in lieu of the O-rings. Other means for detachably connecting the insert, and connected transmitting means if used, from the arrow shaft are discussed in the following description.

According to one preferred embodiment of this invention, the transmitting means and a transmitting means shaft form one integral piece. A transmitting means antenna extends outward from the back portion of the transmitting means. The external threads of the transmitting means shaft engage with the internal threads of a preferably elongated arrow shaft insert. The body of the transmitting means draws snugly against the rear face of the adapter. In another preferred embodiment according to this invention, the transmitting means is housed within a transmitter casing which is secured to a battery housing. The battery housing is secured to an insert body of an arrow shaft insert which is detachably connected within the arrow shaft.

The external threads of an arrowhead shaft engage with the internal threads of the arrow shaft insert and secure the arrowhead in a locked position adjacent the front face of an external shoulder which is located on the front portion of the arrow shaft insert. The arrow shaft insert, transmitting means and transmitting means antenna fit within the arrow shaft, preferably at the front portion of the arrow shaft.

Since the transmitting means, transmitting means antenna, and insert fit within the arrow shaft, the transmitting means will have no negative effects on the aerodynamic propertied of the arrow. In the preferred embodiment of this invention, the transmitting means has negligible effects on the pitch and offset radial balance of the arrow. The transmitting means has relatively light weight as compared to the arrowhead and remainder of the arrow and thus causes only a slight increase in the weight of the front portion of the arrow. Preferably, the center of gravity of the transmitter is located on the centerline of the arrow shaft and causes no offset radial unbalance.

Transmitting means according to one preferred embodiment of this invention will remain intact and lodged within an animal's body even when the animal grasps and forcefully jerks the arrow shaft from the arrowhead and connected arrow shaft insert. This invention is used to detect not only the proximity or precise location of an arrow lodged in the body of fleeing game but also the proximity or precise location of a discharged arrow which misses its target and becomes lost in the brush. Throughout this specification, the phrase "proximity or precise location" generally defines the word "location". Also, the term "arrow shaft insert" is interchangeable with the term "insert".

BRIEF DESCRIPTION OF THE DRAWINGS

FIG. 8 shows a partial sectional view along line 8A—8A, as shown in FIG. 8;

DESCRIPTION OF THE PREFERRED EMBODIMENTS

Figure 1:
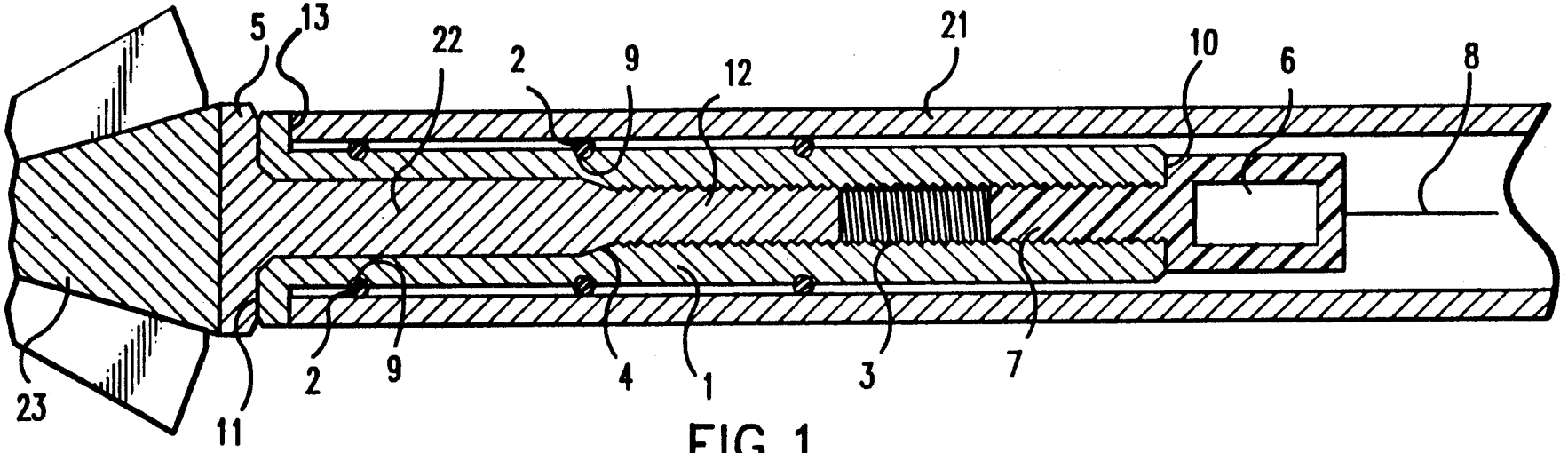
FIG. 1 shows a cross-sectional side view of an arrowhead and insert mounted within an arrow shaft and a transmitting means is shown secured to the insert, according to one embodiment of this invention.

FIG. 1 is a cross-sectional view of a detachably mounted arrowhead, insert body and transmitter. FIG.

2 shows a cross-sectional side view of an arrow shaft insert as shown in FIG. 1, shown and referred to as insert body 1, and connected transmitting means 6 according to one embodiment of this invention. The external threads of transmitting means shaft 7 engage with insert threads 3 and secure transmitting means 6, abutting rear face 10, of insert body 1. It is apparent that transmitting means 6 can connect to insert body 1 in other methods such as a snap-in fitting, frictional fitting, or with an adhesive.

Figure 2:
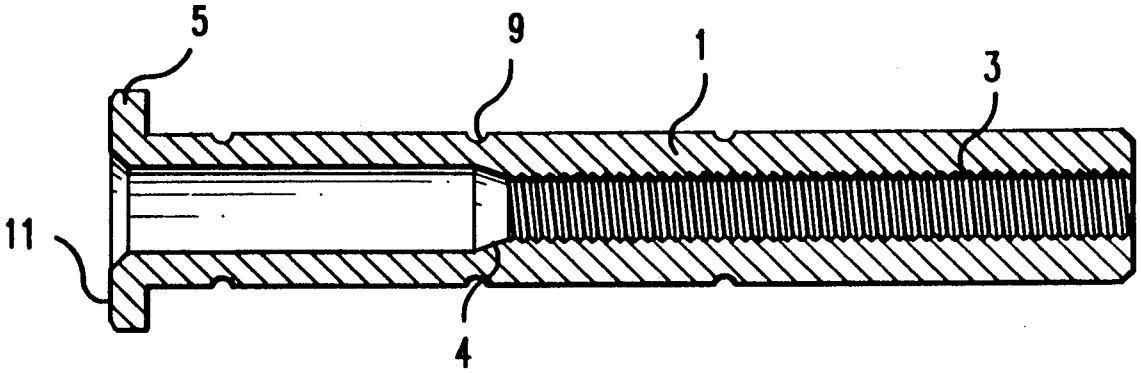
FIG. 2 shows a cross-sectional side view of the insert as shown in FIG. 1.

In one embodiment of this invention as shown in FIGS. 1 and 2, insert body 1 has a plurality of circumferential grooves 9, preferably two or three, spaced along the outer surface of insert body 1. The internal bore of insert body 1 accommodates a standard size arrowhead shaft 22. All externally exposed corners of insert body 1 preferably have chamfered edges to prevent burrs when assembling arrowhead 23, insert body 1 and arrow shaft 21.

Transmitting means 6 emits a frequency signal which is received by a receiving means. Conventional transmitters and receivers can be obtained from electronic manufacturers such as Motorola, or TDK. Some conventional transmitters emit frequency signals used to determine the proximity of the transmitter, while other conventional transmitters emit frequency signals used to determine the precise location of the transmitter. Many conventional manufacturers encase transmitters in various synthetic materials, such as potting compounds. Transmitting means 6, according to one preferred embodiment of this invention, has a lightweight synthetic casing. It is apparent that other lightweight materials such as aluminum or graphite composites may also be suitable materials for constructing transmitter shaft 7 and/or the casing of transmitting means 6.

FIG. 1 shows a cross-sectional side view of an arrowhead insert body 1 and arrowhead shaft 22 in the assembled position, according to one embodiment of this invention. External threads of arrowhead shaft end 12 engage with insert threads 3 and secure arrowhead 23 adjacent front face 11 of insert body 1. Internal shoulder 4 has a contour which accepts the mating contour portion of arrowhead shaft 22.

Once arrowhead 23, insert body 1 and transmitting means 6 have been assembled, insert body 1 and connected transmitting means 6 can be inserted into arrow shaft 21 until the end of arrow shaft 21 abuts external shoulder 5 of insert body 1. The outside diameter of external shoulder 5 can be varied as a function of the outside diameter of arrow shaft 21 so that the outer circumferential side surface of external shoulder 5 preferably mounts flush with the outer circumferential side surface of arrow shaft 21.

Although such particular embodiment shows arrowhead shaft end 12 of arrowhead shaft 22 and transmitting means shaft 7 having the same outside diameters and threads, it is apparent that arrowhead shaft end 12 and transmitting means shaft 7 can have different connection types such as snap-in or rotatable fittings. It is also apparent that insert body 1 having no attached transmitting means 6 can fit inside arrow shaft 21 and thus provide a detachable arrow shaft insert for accepting conventional arrowheads.

According to one embodiment of this invention, transmitting means 6 and/or insert body 1 fit within arrow shaft 21. Circumferential grooves 9 accommodate O-rings 2. O-rings 2 provide a compression fitting between insert body 1 and arrow shaft 21. Transmitting means 6 has a cross section sized not only to fit within arrow shaft 21 but also to allow sufficient compression of O-rings 2. O-ring 2 sizes can be varied as a function of the inside diameter of arrow shaft 21 to provide a snug or compression fit of O-ring 2 between insert body 1 and arrow shaft 21.

Figure 5:
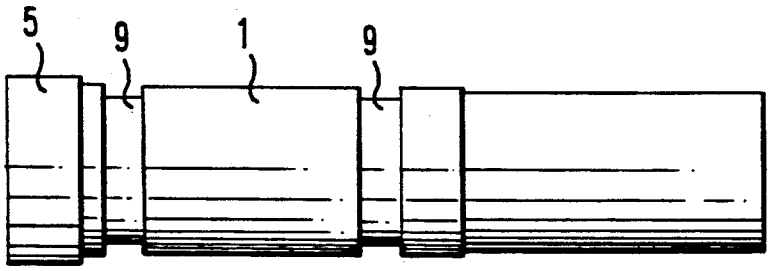
FIG. 5 shows a front view of an insert which accommodates O-rings, according to another embodiment of this invention.
Figure 6:
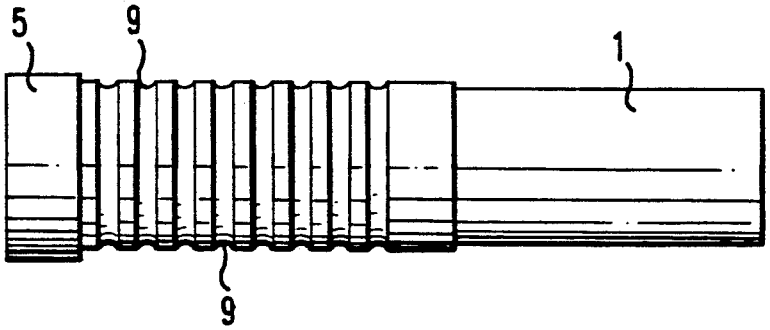
FIG. 6 shows a front view of an insert which also accommodates O-ring, according to another embodiment of this invention.

A plurality, preferably two or three, of circumferential grooves 9 are positioned and sufficiently spaced to provide adequate and stable support of insert body 1 within arrow shaft 21. FIGS. 5 and 6 show other preferred spacings of circumferential grooves 9. O-rings 2 allow quick and easy assembly and disassembly of insert body 1 and arrow shaft 21.

Figure 3B:
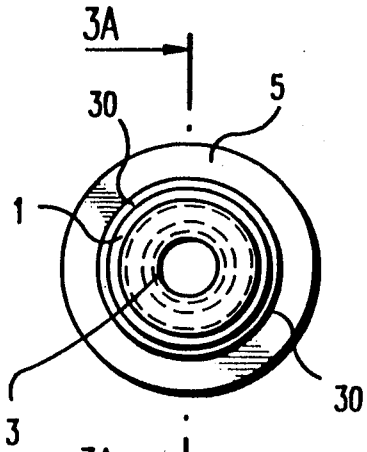
FIG. 3B shows an end view of the insert, as shown in FIG. 3A.
Figure 3A:
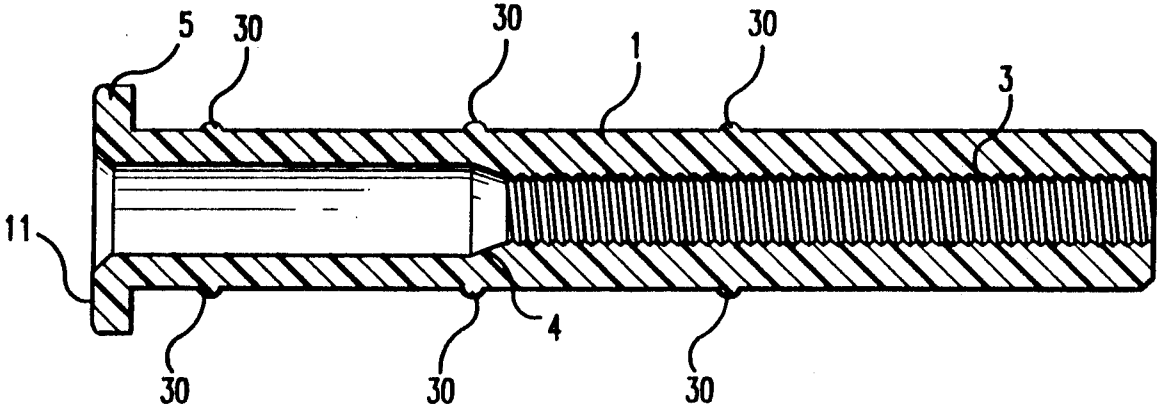
FIG. 3A shows a cross-sectional side view, along line 3A—3A as shown in FIG. 3B, of an insert having integral longitudinal ribs, according to another embodiment of this invention.

In another embodiment of this invention, means for detachably connecting insert body 1 within arrow shaft 21 comprise insert body 1 being constructed of a resilient synthetic material. In one particular embodiment, as shown in FIGS. 3A and 3B, the outer surface of insert body 1 has a plurality of circumferential ribs 30 which compress and provide a snug or compression fit or press fit between insert body 1 and arrow shaft 21, in the same manner as O-rings 2 described above in the previous embodiment. In yet another embodiment of this invention, as shown in FIGS. 4A and 4B, circumferential ribs 30 are replaced with longitudinal ribs 35.

Figure 4B:
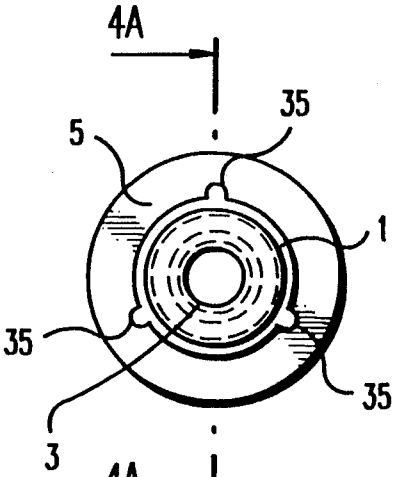
FIG. 4B shows an end view of the insert, as shown in FIG. 4A.
Figure 4A:
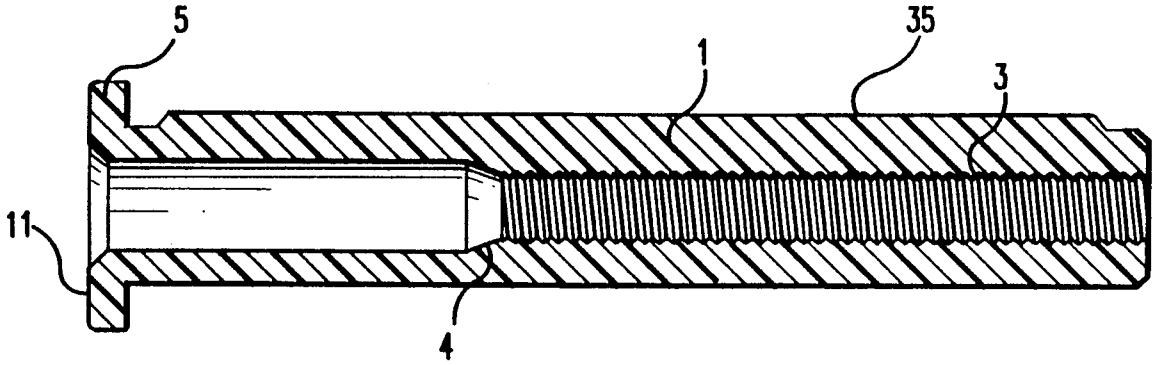
FIG. 4A shows a cross-sectional side view, along line 4A—4A as shown in FIG. 4B, of an insert having integral circumferential ribs, according to another embodiment of this invention.

As shown in FIGS. 3A–4B, 7, 8 and 8A either circumferential ribs 30 or longitudinal ribs 35 are integral elements with insert body 1. It is apparent that insert body 1 must have a plurality or at least two circumferential ribs 30 in order to adequately provide support for insert body 1 within arrow shaft 21. More than two circumferential ribs 30 will provide more stable support of insert body 1 within arrow shaft 21. Likewise, insert body 1, as shown in FIGS. 4A and 4B, must have at least two longitudinal ribs 35 to adequately support insert body 1 within arrow shaft 21. If only two longitudinal ribs 35 are used, they must be precisely 180° apart. However, it is preferred to have at least three longitudinal three ribs 35 to provide sufficient support in a tripod fashion.

It is apparent that either circumferential ribs 30 or longitudinal ribs 35 can also protrude from the inner wall of arrow shaft 21 rather than from the external wall of insert body 1. In such embodiment, insert body 1 preferably has a smooth outer surface. It is likewise apparent that a separate sleeve insert having or accommodating circumferential ribs or longitudinal ribs can fit inside of arrow shaft 21 and thereby detachably connect a mating insert body 1 with respect to arrow shaft 21.

In another preferred embodiment of this invention, transmitting means 6 attaches within arrow shaft 21 near the nock end, in a fashion similar to the manner in which transmitting means 6 attaches within arrow shaft 21 near the arrowhead end of arrow shaft 21. However, the preferred embodiment of this invention has transmitting means 6 attached to insert body 1, both being positioned near arrowhead 23, for better weight distribution. Front-end weight distribution provides better arrow stability during flight. Also, transmitting means 6 attached to the nock end will not remain attached to an animal's body if arrow shaft 21 should break off or if the animal should remove arrow shaft 21 from its body.

Quick and easy detachable separation between insert body 1 and arrow shaft 21 is a particularly important aspect of this invention. In game hunting, animals can use their mouths or body limbs to grasp and forcefully break off an arrow shaft at or near the arrowhead connection. Thus transmitting means 6 mounted to a conventional-type arrowhead assembly would break off with the arrow shaft. Transmitting means 6 according to this invention is secured to insert body 1 which is secured to arrowhead 23. Because of the O-ring type or similar detachable type connection according to this invention, an animal can grasp and pull arrow shaft 21, thus separating arrow shaft 21 from insert body 1 and thereby leaving the assembly of arrowhead 23, insert body 1, and, more importantly, transmitting means 6 attached to or lodged within the animal's body. The quick and easy assembly and disassembly of insert body 21 is also particularly important since it provides for precise arrowhead installation in the field without the need for blade wrenches and other tools.

Insert body 1 of this invention can be used with or without transmitting means 6, as described above. When used with transmitting means 6, insert body 1 allows an attached transmitting means 6 to remain lodged within the animal or other target even if arrow shaft 21 is removed from the body of the animal or the target. Without connection of transmitting means 6 to insert body 1, insert body 1 is particularly useful for quick and easy field installation of arrowhead 23 or other conventional arrowheads or broadheads.

Insert body 1 of this invention is preferably constructed of a plastic or polymeric material, such as G-10 plastic. With such materials, insert body 1 can be injection molded in mass quantities at relatively low costs.

Figure 7:
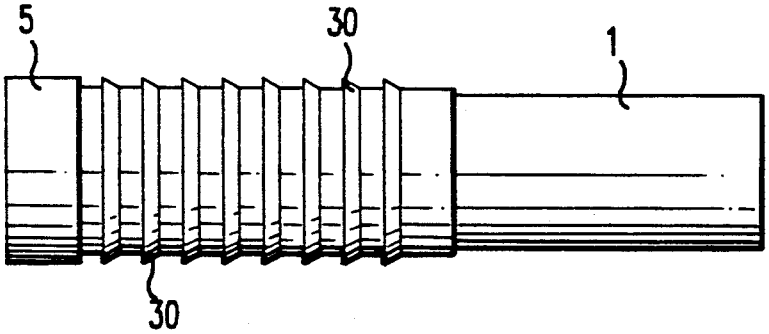
FIG. 7 shows a front view of an insert having circumferential ribs, according to another preferred embodiment of this invention.
Figure 8:
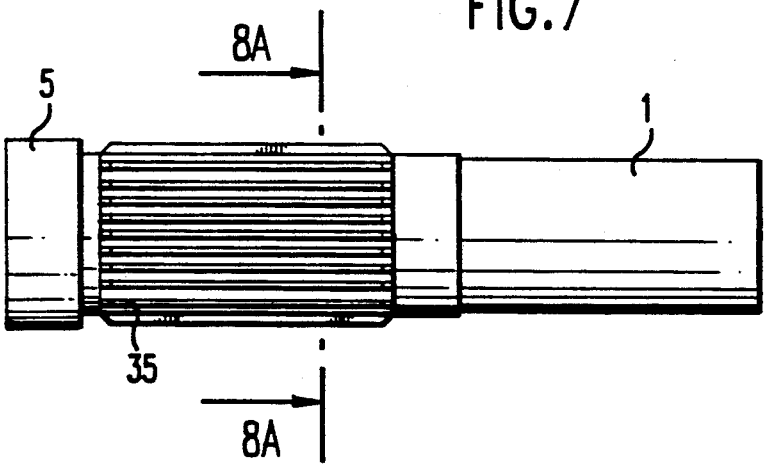
FIG. 8 is a front view of an insert having longitudinal ribs, according to yet another preferred embodiment of this invention.
Figure 8A:
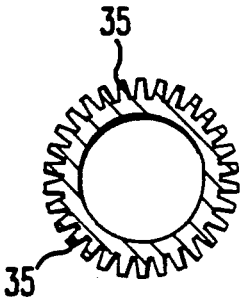
Figure 9:
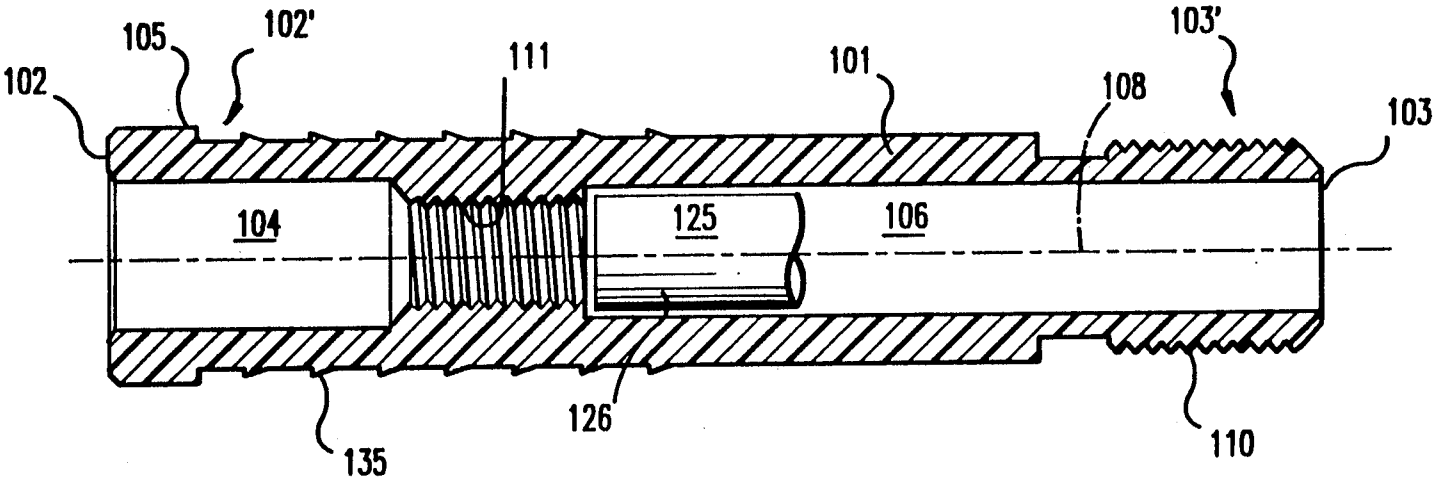
FIG. 9 is a cross-sectional view of an insert body, according to one preferred embodiment of this invention.
Figure 10:
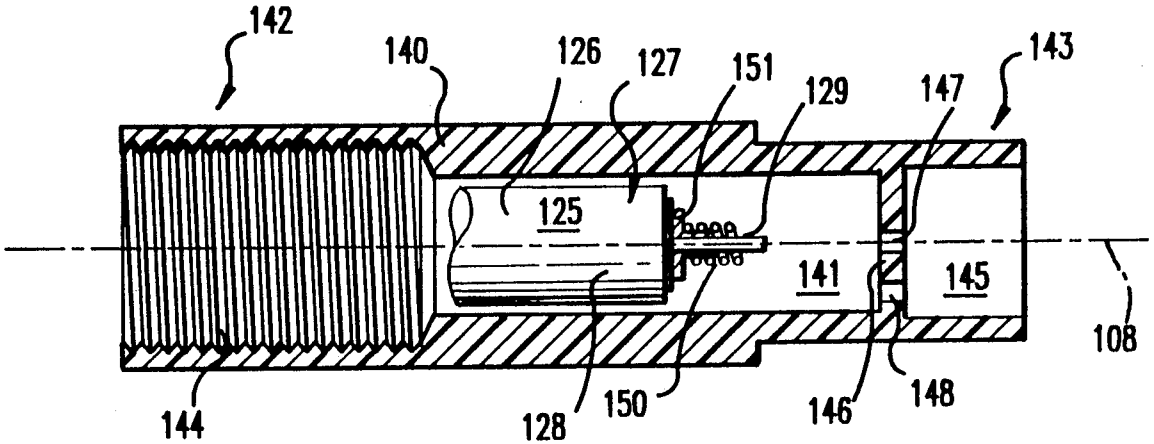
FIG. 10 is a cross-sectional view of a battery housing, according to one preferred embodiment of this invention.
Figure 11:
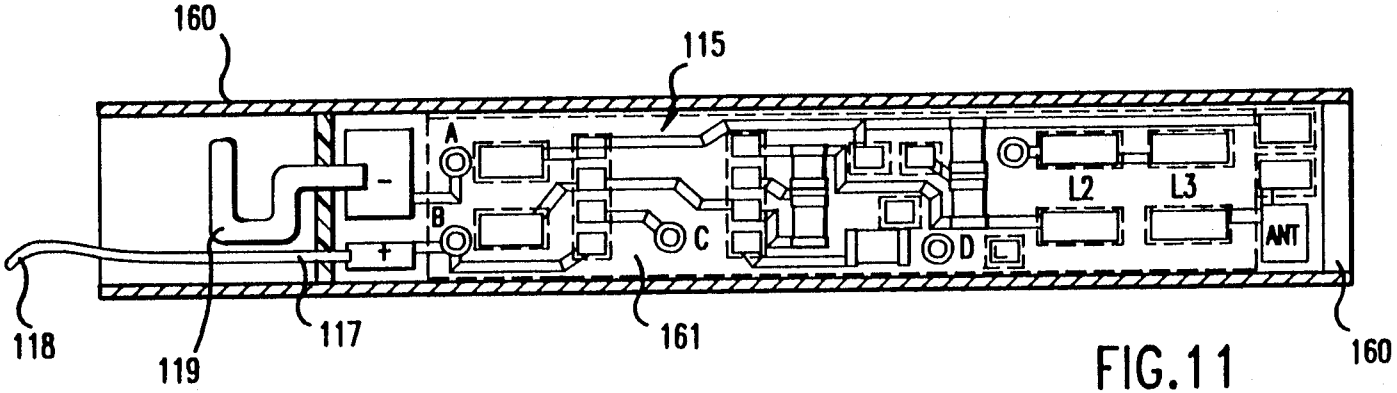
FIG. 11 is a cross-sectional view of a mounted transmitter within a transmitter casing, according to one preferred embodiment of this invention.
Figure 11A:
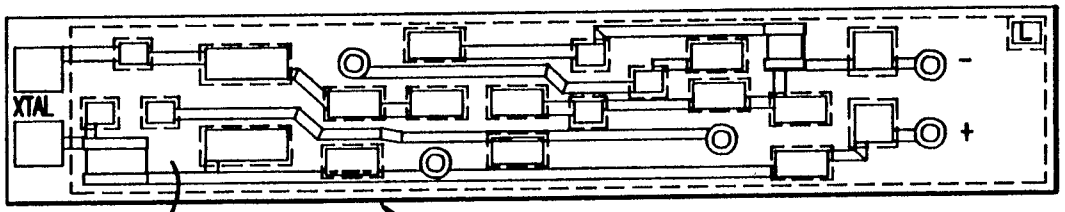
FIG. 11A is a bottom view of the circuit board of the transmitter as shown in FIG. 11.
Figure 12:
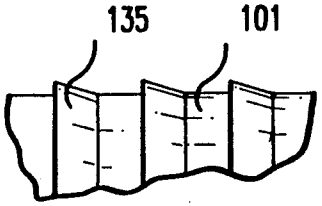
FIG. 12 is an enlarged view of the circumferential ribs, as shown in FIGS. 7 and 9.

In another preferred embodiment according to this invention as shown in FIGS. 9–13A, insert body 101, battery housing 140 and transmitter casing 160 are secured with respect to each other to form a removable arrowhead transmitting device. It is an important aspect of this invention for the entire assembly of insert body 101, battery housing 140 and transmitter casing 160, particularly insert body 101 to be detachable or readily separated from arrow shaft 21. Such detachable aspect of this invention can be accomplished, as previously discussed, with an insert having O-rings, longitudinal ribs and/or circumferential ribs, as shown in FIGS. 1–9 and 12, particularly with a triangular cross-sectional area that diverges forward toward the arrowhead, as shown in FIGS. 7, 9 and 12. For example, when an arrow strikes and becomes lodged within a deer or other animal which is injured but not killed, the deer or other animal often attempts to pull the arrow out of its body. With removable insert body 101 according to this invention, the deer, for example, would be able to remove arrow shaft 21 from its body while leaving the arrowhead, insert body 101, battery housing 140 and transmitting casing 160, as well as all other necessary components for transmitting a frequency signal, within the deer's body.

Thus, the word "detachable" or "removable" as used throughout the specification and in the claims, is intended to relate to insert body 101 being secured within arrow shaft 21 tight enough or with enough friction so that the arrowhead does not separate from arrow shaft 21 during normal handling, shooting procedures and arrow flight, yet insert body 101 being secured loose enough for insert body 101 to separate from arrow shaft 21 when the arrowhead is lodged within a target and a rearward pulling force is applied to arrow shaft 21.

At least a portion of arrow shaft 21 which is adjacent arrow shaft end 123 is hollow. Most conventional arrow shafts are hollow from the arrowhead end to the nock end. However, it is apparent that this invention will function even with arrow shaft 21 which is not completely hollow or is not a one-piece arrow shaft, as long as insert body 101 battery housing 140 and transmitter casing 160 are housed within such hollow portion of either the arrow shaft or an extension thereof.

Elongated insert body 101 has forward end 102, forward body portion 102', rearward end 103 and rearward body portion 103', as shown in FIG. 9. Insert body 101 is detachably mounted within arrow shaft 21. Arrow shaft 21 is shown in FIG. 1. As used in this specification and the claims, the phrase "detachably mounted" also relates to insert body 101 being detachably secured within arrow shaft 21 forming a friction fit or press fit between insert body 101 and an inside wall of arrow shaft 21. It is important to note that insert body 101 is not permanently secured within arrow shaft 21, with epoxy, another adhesive or any other suitable permanent connection. Insert body 101 also forms external shoulder 105 at forward end 102. External shoulder 105 preferably abuts arrowhead shaft end 12 of arrow shaft 21. Arrowhead shaft end 12 is shown in FIG. 1. Forward body portion 102 forms shaft cavity 10 which is sized to accommodate a standard and conventional arrowhead shaft end 12. To accommodate such standard component, shaft cavity 104 is at least partially internally threaded, as shown in FIG. 9.

Rearward body portion 103' forms body battery cavity 106. As shown in FIG. 9, body battery cavity 106 has a circular cross section and the diameter of such cross section is preferably equal to or greater than the external diameter of externally threaded arrowhead shaft end 12. With such arrangement, arrowhead shaft end 12 can extend into body battery cavity 106 and force battery body 126 rearward, to the right as shown in FIGS. 9 and 10, to engage terminal stud 129 with power supply terminal 117, as shown in FIG. 11. Also with such arrangement, battery body 126 can have a cylindrical forward end for engagement with arrowhead shaft end 12. It is apparent that rearward body portion 103' is not required to have a circular cross section since other cross-sectional shapes will function to produce the same result. Regardless of the cross-sectional shape of rearward body portion 103, if arrowhead shaft end 12 is designed to force battery body 126 rearward, then the minimum diameter or dimension of a line segment which passes through center line axis 108 must be greater than the external diameter of externally threaded arrowhead shaft end 12. In another preferred embodiment according to this invention, such diameter or dimension of the segment which passes through center line axis 108 can be less than the external diameter of externally threaded arrowhead shaft end 12 as long as battery body 126 has a forward extending portion which makes contact with arrowhead shaft end 12 before arrowhead shaft end 12 bottoms out within shaft cavity 104.

Insert body 101 is secured to battery housing 140. Battery housing 140 defines housing battery cavity 141. With insert body 101 secured to battery housing 140, battery body 126 is positioned within body battery cavity 106 and housing battery cavity 141, as shown in FIGS. 9 and 10. In one preferred embodiment according to this invention, rearward body portion 103' has external threads 110 which are matingly engageable with internal housing threads 144 of forward housing portion 142. It is apparent that any other suitable connection, such as a press fit, can be used to secure insert body 101 to battery housing 140. However, it is an important aspect of this invention for the connected insert body 101 and battery housing 140 to fit within arrow shaft 21 with enough tolerance so that such elements can easily be removed from within arrow shaft 21.

Figure 10A:
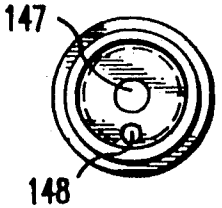
FIG. 10A is a side view of the battery housing, from the right as shown in FIG. 10.

Rearward wall 146 of battery housing 140 has central through hole 147 and offset through hole 148, as shown in FIGS. 10 and 10A, both which are in communication with housing battery cavity 141. As shown in FIG. 6, battery housing 140 has a step down shoulder at rearward housing portion 143. Such step down shoulder accommodates transmitter casing 160. In an assembled position, transmitter casing 160 is secured to rearward housing portion 143 by an inside diameter of transmitter casing 160 fitting over an outside diameter of rearward housing portion 143. In one preferred embodiment according to this invention, such connection is secured with epoxy or another suitable adhesive. However, it is apparent that other suitable connections known within the art can be used.

Figure 11B:
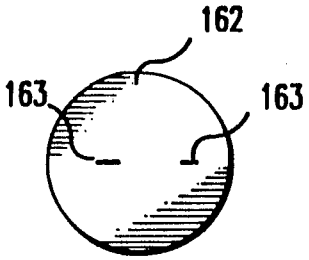
FIG. 11B is a front view of a flexible washer which fits within the transmitter casing, as shown in FIG. 11.

Transmitting means are used to emit a frequency signal from within arrow shaft 21. In one preferred embodiment, such transmitting means comprises a transmitter which is commercially available and can be constructed by a person skilled in the art of electronics. The transmitting means also comprises circuit board 161 which is housed within transmitter casing 160. As shown in FIG. 11, transmitter casing 160 comprises a tube, preferably of aluminum or a synthetic material. Circuit board 161 fits snugly within transmitter casing 160. To assemble the transmitting means circuit board 161 is inserted into transmitter casing 160. Washer 162, is preferably of a rubber or other flexible material and has a diameter approximately equal to the inside diameter of transmitter casing 160, which is approximately equal to the outside diameter of rearward housing portion 143. According to one preferred embodiment of this invention, washer 162 also has two slits 163, as shown in FIG. 11B, through which power supply terminal 117 and power supply terminal 119 extend. It is apparent that if power supply terminal 117 is positive, then power supply terminal 119 is negative, and vice versa. Continuing with a description of one assembly of the transmitting means, washer 162 is positioned within a forward end of transmitter casing 160. Power supply terminal 117 and power supply terminal 119 are positioned to extend through slits 163 and into cavity 145, which is rearward of rearward wall 146. Washer 162 will not extend into cavity 145 since the diameter of washer 162 is preferably the same as the outside diameter of rearward housing portion 143 and thus abuts the rearward end of rearward housing portion 143. Once washer 162 is in position, a potting compound can be poured into transmitter casing 160 from the rearward end of transmitter casing 160. Such potting compound can be selected to absorb shock and further protect the electronic components of the transmitting means. Washer 162 also serves a purpose of a shock absorber for preventing shock to the transmitting means, when the arrow hits a target.

Power supply terminal 119 extends within cavity 145 through slit 163 and as far as rearward wall 146 when assembled, and preferably has a serpentine shape as shown in FIG. 11. Power supply terminal 117 extends from the circuit board through slit 163, further through offset through hole 148 of rearward wall 146, and is urged toward center line axis 108, so that free end portion 118 of power supply terminal 117 constantly contacts terminal surface 128, as shown in FIG. 10, of battery body 126. Free end portion 118, at its terminal end, is flared outward from center line axis 108 so that when battery body 126 is removed and then again inserted, power supply terminal 117 does not kink or bend.

Figure 13A:
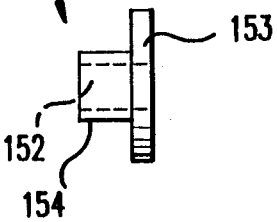
FIG. 13A is a side view of the spring guide, as shown in FIG. 13.
Figure 13:
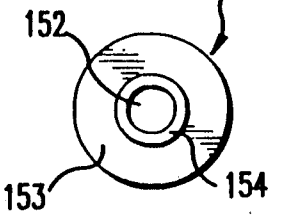
FIG. 13 is a front view of a spring guide, according to one preferred embodiment of this invention.

In the assembled position of insert body 101 and battery housing 140, battery body 126 is constantly urged forward toward the arrowhead. In one preferred embodiment according to this invention, such urging force is accomplished with spring 150 and spring guide 151, as shown in FIG. 10. As shown in FIGS. 13 and 13A, spring guide 151 has flange 153 and shoulder 154. Central guide through hole 152 extends through flange 153 and shoulder 154. Terminal stud 129 of battery body 126 is mounted within central guide through hole 152, as shown in FIG. 10. Spring 150 is then mounted over shoulder 154 and thus terminal stud 129. When the arrowhead is assembled within shaft cavity 104, forward end of spring 150 abuts flange 153 and a rearward end of spring 150 abuts rearward wall 146. With such arrangement, when the arrowhead is not inserted within insert body 101, battery body 126 is urged forward and thus terminal stud 129 does not make contact with power supply terminal 119. However, when arrowhead shaft end 12 is threaded within shaft cavity 104, arrowhead shaft end 12 engages with battery body 126 to push it rearward. With such rearward motion, terminal stud 129 extends through central through hole 147 and makes electrical contact with power supply terminal 119. Such electrical connection energizes the transmitting means. Thus, according to one preferred embodiment of this invention, the transmitting means is switched on when the arrowhead is mounted within insert body 101. Also, to switch the transmitting means off, the arrowhead is simply removed from insert body 101. This aspect of the invention eliminates momentum electrical switches and the like, thus providing a more reliable system than other conventional energizing systems.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein ca be varied considerably without departing from the basic principles of the invention.

I claim:

1. A detachable arrowhead transmitting apparatus comprising:

an arrow shaft, at least a portion of said arrow shaft adjacent an arrowhead shaft end of said arrow shaft being hollow;

an elongated insert body having a forward end and a rearward end, mounting means for detachably mounting said insert body within said arrow shaft, said insert body forming an external shoulder at said forward end, said external shoulder abutting said arrowhead shaft end, a forward body portion of said insert body forming a shaft cavity sized and at least partially internally threaded to accommodate an externally threaded arrowhead shaft of the arrowhead, a rearward body portion of said insert body forming a body battery cavity, said rearward body portion of said insert body having external threads;

a battery housing defining a housing battery cavity and sized to fit within said arrow shaft, a forward housing portion of said battery housing forming internal housing threads mateable with said externally threaded portion of said insert body, a rearward wall of said battery housing defining a central through hole and an offset through hole both in communication with said battery housing cavity, spring means positioned within said battery housing for forcing a battery toward the arrowhead; and transmitting means for emitting a frequency signal, said transmitting means housed within a transmitter casing, said transmitter casing secured to a rearward housing portion of said battery housing, said transmitting means comprising an elongated power supply terminal extending through said offset hole and urged inward toward said centerline axis.

2. An apparatus according to claim 1 further comprising a battery power supply housed within said body battery cavity and said housing battery cavity.

3. An apparatus according to claim 2 wherein a free end portion of said power supply terminal is in continuous contact with one of a positive terminal surface and a negative terminal surface of said battery power supply.

4. An apparatus according to claim 2 wherein said battery power supply further comprises an elongated battery body, one of a positive terminal stud and a negative terminal stud extending rearward from a rearward battery end of said battery body.

5. An apparatus according to claim 4 wherein said spring means further comprises: a spring guide defining a central guide through hole, said spring guide having a flange and a shoulder, a spring, said spring mounted over said shoulder, a forward end of said spring abutting said flange, a rearward end of said spring abutting said rearward wall of said battery housing, and said one of said positive terminal stud and said negative terminal stud extending through said central guide through hole.

6. An apparatus according to claim 5 wherein upon insertion of said arrowhead shaft within said shaft cavity said arrowhead shaft engages said battery body to force said battery body rearward and thus push said one of said positive terminal stud and said negative terminal stud rearward through said central through hole and engage said one of said positive terminal stud and said negative terminal stud with a corresponding power supply terminal of said transmitting means.

7. An apparatus according to claim 1 wherein said mounting means further comprise: an external surface of said insert body forming a plurality of circumferential ribs, each said circumferential rib having a triangular cross section diverging forward toward the arrowhead, and an external rib diameter being greater than an internal diameter of said arrow shaft.

8. An apparatus according to claim 1 wherein said mounting means further comprise a plurality of circumferential ribs secured to an external surface of said insert body and an external diameter of each said circumferential rib being greater than an internal diameter of said arrow shaft.

9. An apparatus according to claim 1 wherein said mounting means further comprise a plurality of longitudinal ribs secured to an external surface of said insert body and an external diameter of said insert body plus two times a height of one of said longitudinal ribs being greater than an internal diameter of said arrow shaft.

10. An apparatus according to claim 1 wherein said mounting means further comprise: said insert body defining a plurality of circumferential grooves on an outer surface of said insert body, each said circumferential groove accomodating an O-ring, and each said O-ring when mounted within a corresponding circumferential groove having an external diameter greater than an internal diameter of said arrow shaft.

11. An apparatus according to claim 1 wherein a dimension of said body battery cavity perpendicular to and passing through a centerline axis of said insert body is at least as great as an external diameter of said externally threaded arrowhead shaft.

12. An apparatus according to claim 1 further comprising a battery power supply housed within said body battery cavity and said housing battery cavity, a dimension of said body battery cavity perpendicular to and passing through a centerline axis of said insert body being greater than an external diameter of said externally threaded arrowhead shaft, and a battery body of said battery power supply having a forwardly extending body portion engageable with a rearward shaft end of said externally threaded arrowhead shaft.

* * * * *